US006814514B2

(12) United States Patent
Korngold et al.

(10) Patent No.: US 6,814,514 B2
(45) Date of Patent: Nov. 9, 2004

(54) POSITION INDICATION ON PHOTOGRAPHIC BASE

(75) Inventors: Bruno Alexander Korngold, Waalwijk (NL); Antonius Jozef van Hooff, Breda (NL); Robert Hendrik Johan Sandifort, Waalwijk (NL); Josephus Nicolaas Petrus Verhoeven, Oss (NL)

(73) Assignee: Fuji Photo Film B.V., Tilburg (NL)

( * ) Notice: Subject to any disclaimer, the term of this patent is extended or adjusted under 35 U.S.C. 154(b) by 87 days.

(21) Appl. No.: 09/922,414

(22) Filed: Aug. 3, 2001

(65) Prior Publication Data

US 2002/0030704 A1 Mar. 14, 2002

(30) Foreign Application Priority Data

Aug. 7, 2000 (EP) ..... 00202797

(51) Int. Cl.[7] ..... B41J 15/24
(52) U.S. Cl. ..... 400/621; 400/74; 101/484
(58) Field of Search ..... 400/621, 74; 101/484

(56) References Cited

U.S. PATENT DOCUMENTS 4,025,025 A 5/1977 Bartel et al.
4,746,020 A * 5/1988 Schenk ..... 209/3.3
5,125,037 A * 6/1992 Lehtonen et al. ..... 382/112
5,628,574 A 5/1997 Crowley
5,935,361 A * 8/1999 Takahashi et al. ..... 156/159
6,236,429 B1 * 5/2001 Ho ..... 348/88
6,402,405 B1 * 6/2002 Frodl et al. ..... 400/582

FOREIGN PATENT DOCUMENTS

| | | | |
|---|---|---|---|
| EP | 0 364 934 | 4/1990 | |
| EP | 0490398 | 6/1992 | |
| EP | 0819639 | 1/1998 | |
| EP | 0926552 | 6/1999 | |
| GB | 668914 | 4/1950 | |
| GB | 2 169 402 | 7/1986 | |
| JP | 62280977 | 5/1987 | |
| JP | 2000318132 A * | 11/2000 | ..... B41F/33/14 |

* cited by examiner

*Primary Examiner*—Charles H. Nolan, Jr.
(74) *Attorney, Agent, or Firm*—Banner & Witcoff, Ltd.

(57) ABSTRACT

A method of measuring a down-web coordinate is provided. A time-interval, elapsed since a detection of a position-indicating mark applied on a web, is related to a measured velocity. Upon detection of a position-indicating mark, the measured down-web coordinate is synchronised with the indicated down-web coordinate of said mark. The down-web coordinate can be measured in an ascending or a descending mode, depending on a detected roll-orientation information originated from said mark on said web. A selected lane pattern used for registration of the cross web position can be reversed automatically, depending on said roll-orientation information, originated from said mark on said web. A measured down-web starting position of a quality problem area on the web is marked by an ISO-hole.

32 Claims, 2 Drawing Sheets

Figure 1 Product-Marking and Data-Processing
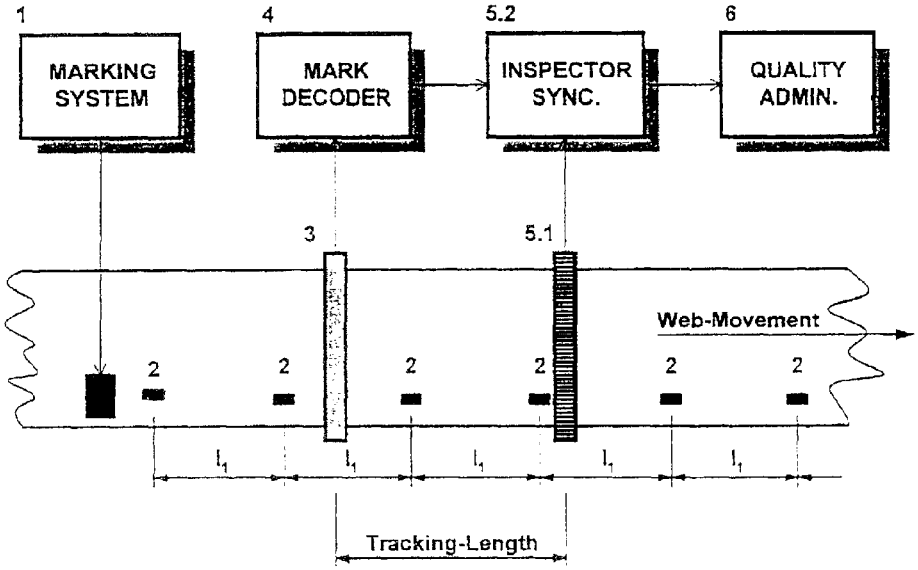

Figure 2 ISO-Hole Punch-Control
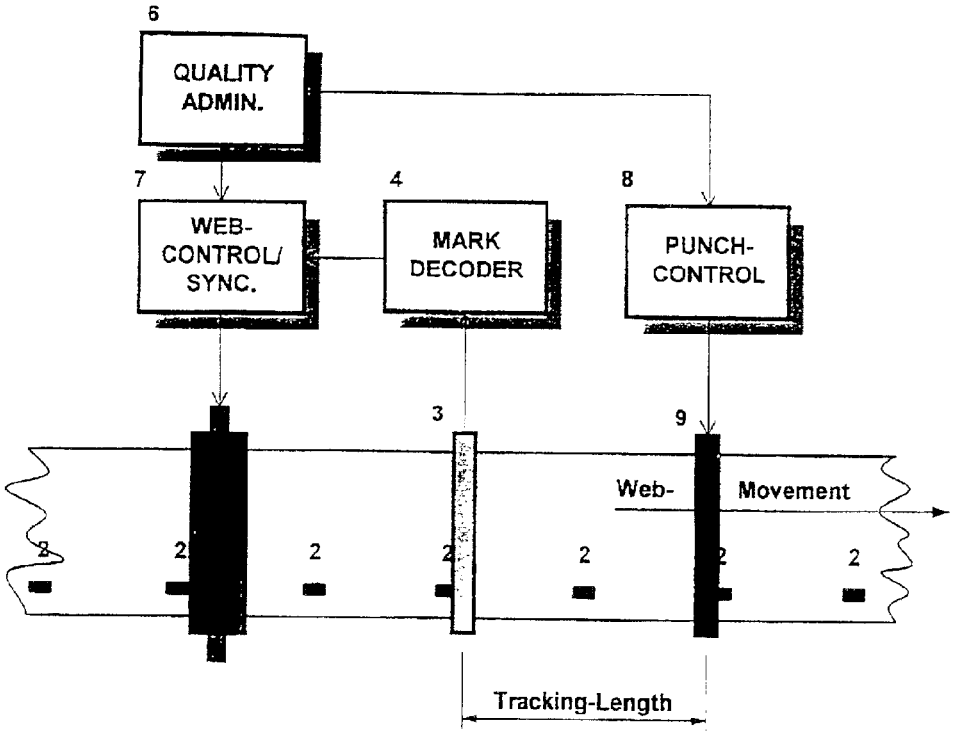
Figure 3 Product Cross-Section
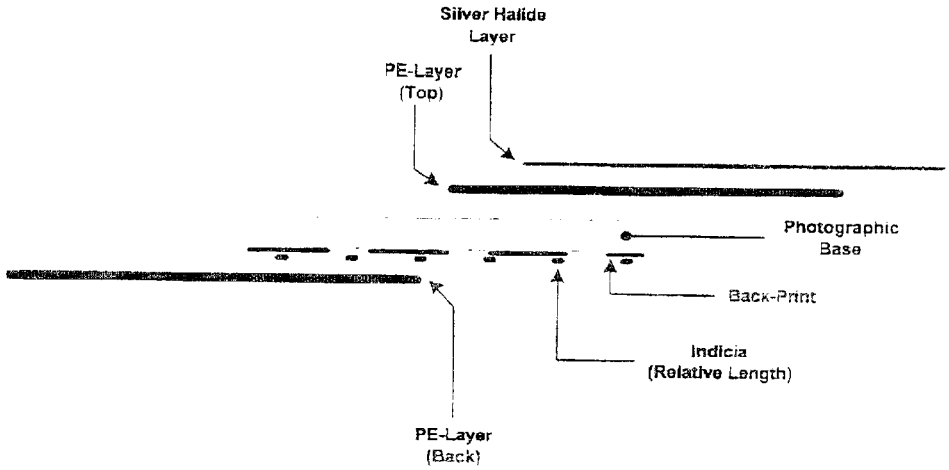

POSITION INDICATION ON PHOTOGRAPHIC BASE

CROSS-REFERENCE TO RELATED APPLICATIONS

This application claims priority to European Application No. 00202797.7 filed on Aug. 7, 2000.

FIELD OF THE INVENTION

The invention relates to a method of measuring a down-web coordinate on a web by relating a time-interval, elapsed since a detection of a position-indicating mark applied on said web, to a measured velocity. The invention also relates to a system for carrying out the method and for tracking the position of quality problem areas at continuous-web products. The invention also relates to photographic paper for use in such a system.

BACKGROUND OF THE INVENTION

Photographic paper is produced as a continuous web, starting with a roll of base paper to which at both sides a sheet containing at least water repellent poly-olefin resin is extrusion coated. In the next manufacturing step a number of photographic emulsions are coated on the top side of said web.

During production of the base paper and the extrusion-coating of the poly-olefin resin layers onto said base paper as well as during the coating of the photographic emulsions, areas with quality problem may occur. These quality problem areas are usually detected by a laser beam analyzer that inspects the full width of the web and exactly registers the cross web coordinate. Additionally the metric down web coordinate is registered at which the quality problem area on the web passes the detector. The term "down-web" is referring to an orientation in the winding direction of a web that is winded on a roll; the term "cross-web" is referring to an orientation in the plane of the web and perpendicular to the "down-web" direction.

The down web coordinate of the quality problem area is not exactly measurable but provides a reasonable indication. The down web coordinate is related to the splice at the beginning of the roll and the speed of the web in relation to the time that has passed since said splice passed the laser beam analyzer. Due to physical phenomena, like slip and stretch, the measured web-length deviates from the actual transported length. This may cause deviation in the measurement of the length coordinate.

The large roll is slitted in the length direction at a special machine into various small rolls, called baby-rolls, that are used in the developing/processing machines at the photo laboratories. In order to be sure that a quality problem area is eliminated from a small roll, a considerable length, say more than 10 meters before and after the indicated down web coordinate, is discarded from that roll. The roll is rewinded and a considerable length of the photographic web is replaced by a part without any quality problem areas. This results in two splices to connect an inserted part. These splices are identified by so called splice indicating holes, as has been stipulated in an ISO-standard, further called ISO-holes, see EP-A-490 398. The ISO-holes are detectable by the image printing machines of the photo laboratories. These small splicing parts of the roll are discarded.

SUMMARY OF THE INVENTION

An object of the invention is to register precisely a down-web coordinate on a web-product. A further object of the invention is to register precisely the down web coordinate of a quality problem area as located in or at the photographic products or at the front or back of continuous web products. Yet another object of the invention is to discard as little material as possible, at removal of the quality problem area from the web.

Still object of the invention is the application of digital product markings at the back of the continuous web, comprising product information like: the roll orientation, the product type code, the product lot number, the roll number, etc.

Another object of the invention is to mark the quality problem area by punching an ISO-hole very close to the quality problem area.

Another object of the invention is the reduction of product losses due to quality problems.

Another object of the invention is the reduction of web handling operations necessary for discarding the web parts with quality problems.

The above mentioned objects are obtained by using the method of the preamble, wherein, upon detection of a position-indicating mark, the measured down-web coordinate is synchronised with the indicated down-web coordinate of said mark.

BRIEF DESCRIPTION OF THE FIGURES

FIG. 1 depicts an example of "Product-marking and data-processing".

FIG. 2 depicts an example of "ISO-bole punch control".

FIG. 3 depicts an example of a cross-section of a product in accordance with an embodiment of the invention.

DETAILED DESCRIPTION OF THE INVENTION

It is noted that the term "synchronised" refers to a relation between the calculation of a down-web coordinate on the basis of a velocity measurement and the detection of a down-web coordinate indicated by a position-indicating mark. This relation may be a substitution of the calculated position by the detected down-web coordinate on said mark, but said detected coordinate may also be corrected for, par example, an offset-value.

The invention thus provides an exact determination of the down-web coordinate. It is noted that EP-A-O 926552 discloses a method of measuring the down web displacement and cross web locations of web materials, particularly of color photographic paper by providing machine readable indicia to the back of photographic paper. These indicia can be detected with straight line measurement without surface contact between two points of high speed webs. It provides the accurate mapping of potentially problematic areas of a web, and allows for the precise and rapid location of such areas for removal. The limits due to drying capacity for the solvent of the ink, or swelling of the rewetted base paper during printing, are eliminated by applying the indicia at a separate, biaxially stretched oriented sheet. A disadvantage of this known method is that an extra, biaxially stretched oriented polymer sheet has to be laminated at the back of the web, in order to absorb the huge amount of ink without interference of the physical- and/or photographic properties. Further, the lamination of such an extra layer and the consumption of the huge amount of ink are costly operations. On the contrary, in the method according to the invention, such a dense plurality of position indicating marks is not necessary, therefore no extra layer is needed for the application of marks on the photographic paper.

Preferably, the down-web coordinate is measured in an ascending or a descending mode, depending on a detected roll-orientation information detected from the mark. A selected lane pattern used for registration of the cross web position may be reversed automatically, depending on said roll-orientation information, originated from said mark on said web.

The exact measurement of the down web coordinate offers the possibility for exact registration of the coordinates of a quality problem area. Therefore, the quantities of photographic paper that are removed from the "baby-rolls", in order to be sure that no quality problems are present in those rolls, can be reduced significantly.

The method according this invention further facilitates the indication of a quality problem area on a web e.g. a photographic paper, by marking a down-web starting position of a quality problem area on the web by an ISO-hole. This is contrary to the existing techniques as set out in the preceding, where an ISO-hole indicates a down-web starting position of a splicing area on the web. This technique is especially preferable if the quality problem area is of an isolated nature. If quality problem areas are of a recurring nature, for example if a comparatively large area of several meters has problem spots, it feasible to use both existing techniques of splicing a web and the technique of indicating a quality problem area according to the invention.

It is noted that the term "starting position" indicates the starting position of a quality problem area in a finished product, used by the printing machines of photo laboratories. Therefore, a printing machine detecting an ISO-hole skips a subsequent part of the photographic paper, now containing a quality problem area rather than a splicing area. Only a short piece of the roll is discarded after development. As a consequence the baby rolls do not have to be rewinded and the two splices, necessary in the prior-art technology, for connecting the replacing part of the web to the two created ends of the cut web, are prevented by our invention.

The invention is also characterized by a system for tracking quality problem areas at continuous-web products, comprising: one or more detection systems for detecting down-web coordinates on a web from a plurality of position-indicating marks applied on said web; one or more product-inspection-systems provided with length-measuring circuitry synchronised with said detected down-web coordinates; a system for data-processing of quality problem areas at least storing the measured down-web coordinates of the respective quality problem areas; a punch control system for ISO-hole punching provided with length-measuring circuitry synchronised with said detected down-web coordinates.

The digitised relative position stored in the marks, makes it possible to abandon the dense continuous marking of the web like prior art systems need. The, by the laser beam analyzer generated quality problem data e.g. quality problem type—cross web coordinate, etc. are stored in a quality data base. By relating the data from the digital mark with the quality database of the inspection system, the exact position of a quality problem area can be registered and traced.

In a further aspect of the invention, photographic paper, comprising a photographic base, enclosed by a water repellent coating, on the front side of which base a photosensitive material is applied, and further comprising a plurality of position-indicating marks, is characterized in that the plurality of position-indicating marks is applied directly on the photographic base.

A down-web coordinate could be derived from a position-indicating mark by counting a total of detected marks multiplied by a respective interval-length between said marks. However, preferably, the down-web coordinates of said marks are indicated by digitised information contained in said marks. In this way, via a direct read out of such information from a mark, the down-web coordinate of said mark can be derived. The marks may not be visible for the human eye. The marks may be applied to the back of the photographic base. The marks may be applied at regular intervals.

By preference, the marks applied on the photographic paper according the invention are spaced at a distance ranging from 10 cm–20 m. In this range, a shorter value would increase the reliability of the measured distance; wherein the manufacturing costs would increase and wherein a physical limit would be the absorption capacity of the photographic paper.

Another advantage of the incidental marking of the base paper is the prevention of problems like swell, which is characteristic for large amounts of applied ink without the need for an extra poly-olefin sheet at the back of the web.

A further advantage is, that the ISO-holes, applied during the slitting process, will be detected by the processing machine that discards a predefined, small area around the ISO-hole. In this way as little as possible web material is lost.

Another advantage is that no extra operational handling is needed for rewinding the baby-rolls with problems and discarding great lengths of those baby-rolls.

In a further elucidation of the present invention, embodiments are shown of methods and apparatus according to the present invention, with reference to the following drawings and in comparison to prior art:

FIG. 1: "Product-Marking and Data-Processing", shows the web at the first phase of the production process with the various devices and the marks at a constant interval and the "Tracking-Length" between the mark-decoder and the inspection system.

FIG. 2: "ISO-hole Punch Control", shows the web at a later phase of the production process with mark-detector and the equipment for punching the ISO-holes.

FIG. 3: "Product Cross-section", shows the position of the indicia at the back of the photographic base.

The system according to the invention for tracking quality problem areas, as shown in the annexed drawings comprises:

1. A system for marking a continuous-web product at high web speed;
2. A plurality of marks on the product at a distinct distance of each other containing digitised information;
3. A system for detection of the marks; These marks may be visible or invisible for the human eye;
4. One or more decoding systems for decoding and data processing of the mark contents in such way that it registers the relative down-web coordinate of the mark as a reference for the next and previous part of the web;
5. One or more on-line product inspection systems provided with synchronizing circuitry to detect possible quality problem areas and to register the down-web coordinates of said quality problem areas as related to the previously detected position indicating-mark;
6. A system for the processing of data of quality problem areas, providing the slitting machine with ISO-hole punch coordinates;
7. A web length measuring system with synchronizing circuitry, providing data for web-control and ISO-hole punch control, to punch the ISO-hole accurately in the quality problem area;

8. A control-system for ISO-hole punch control;
9. The ISO-hole punching device, that punches the ISO-hole in the baby-roll through or near the quality problem area.

FIG. 1 shows the web with the marking system (1) that applies the product marks (2) on the web, which may be paper, photographic paper, photographic film base, metal- or polymer sheet, containing digitised information about the relative down web position of said mark, the roll-orientation, the product-type and the lot- and roll-numbers, on the web. These marks are the reference for the down-web coordinates. The length between an imaginary line perpendicular to the web transport direction through a specific position of the previous mark and a quality problem area is digitally registered, based on the line speed, and the time difference in passing the detection system by both items. The line speed can be measured with conventional means like a tracking wheel. However, the line speed can also be derived from the time-intervals between the detection of a plurality of marks, e.g. by dividing the distance between two marks by the time-interval between the detection of said marks.

For tracking the position of quality problem areas, detected by said product-inspection system (5.1), the length-measurement of said product-inspection system is synchronised (5.2) to the position of said mark (2) on said web. Said mark (2) is detected by mark detector (3) which is located at a prefixed distance, the Tracking-Length, from the product-inspection system (5.1).

Depending on the roll orientation, read from said marks, the inspection-system's length-counting direction has been automatically set into an ascending or descending counting mode while a lane pattern, used for registration of the cross web position of said detected quality problem areas will be reversed automatically. The lane pattern shows a pattern of divisions across the web and is used by an inspection-system for mapping of detected quality problem areas.

Depending on said roll orientation the position of the quality problem area will therefore be synchronised with the position of the last detected mark on said web. The measured data are registered in the quality system (6) to be used at a later phase of the product preparation.

By synchronizing the inspection-systems length-counter with the relative down-web-position of the mark, correction is made for the deviation in down-web length-measurement that can arise within the distance between two marks, due to slipping and stretching of the web, calculating-errors, etc.

The information, stored in the mark (2), is used in interaction with an on-line inspection system (5.1), in advance of reaching the check-point of that inspection system.

At a roll change in the coating process, (ref. FIG. 1), the counting mode selection of the inspection systems down web length measurement, automatically changes from the individual—to the synchronised mode by a control signal of the mark decoder (4). The synchronization of the Inspection system down-web length measurement occurs by tracking the inspection system's check point (5.1) to the detection position of each mark (3) and by substitution of the momentary value of the inspection system's length counter by the position information originated from each mark (2) and processed by a system for decoding that mark (4). The inspection system reports the quality problem areas in such way, that the quality problem coordinates will be registered at a specific sub-length unit and at a specific cross web lane position as generated by the product inspection system (5.1).

The length counting direction will be ascending or descending, depending on the roll orientation. The specific cross web lane-position data will be reversed depending on the roll orientation.

FIG. 2 shows the web in the final phase before slitting into baby-rolls. The web-controller/synchronizer (7) sets the length-counting direction automatically into an ascending or descending counting mode while a lane pattern, used for registration of the cross web position of said detected quality problem areas will be reversed automatically. Depending on said roll orientation the coordinate of the quality problem area will be synchronised with the last detected mark on said web.

The coordinates of the quality problem area in down web and cross web directions are determined precisely and calculated by the system for data-processing of the quality problem areas (6). In the slitting process the web is marked by punching an ISO-hole before the large roll is slitted into baby-rolls with various widths. Therefore the position of an ISO-hole punching device is traversed to the cross web center position of the slit area where the next problem is expected. For proper positioning of the web the detected and decoded information of the marks on the web is transferred to a web controller (7).

Based on the collected information of the position of the quality problem area and the orientation of the roll in the slitting device, the ISO-hole punch control (8) is triggered via acknowledgement of the mark (2) on the web to punch an IS0-hole in the web within a few centimeters of the quality problem area. Then the slitting into baby-rolls occurs. For the production of image copies the baby-roll is processed in a processing device and the processing device cuts, via acknowledgement of the ISO-hole in the baby-roll, and discards a small part of the baby-roll to prevent quality problem areas in the image copies.

At a roll change in the slitting process, (ref. FIG. 2), the counting mode selection of the web control position measurement automatically changes from the individual—to the synchronised mode by a control signal of the mark decoder (4). The synchronization of the web position measurement occurs by tracking the location of the punch device (9) to the detection position of each mark (3) and by substitution of the momentary value of the web length counter by the position information originated from each mark (2) and processed by a system for decoding that mark (4).

For tracking of the position of quality problem areas, detected by said product-inspection system (5.1), to the position of the ISO-hole punching system (9), the web-controller (7) is synchronised to the position of said mark (2) on said web.

The specific cross web lane-position data will be reversed depending on the roll orientation. As result of the synchronization an ISO-hole can be punched at a specific position within the area that contains the quality problem area.

FIG. 3 shows a cross section of the photographic paper with in the middle the photographic base paper containing, at the back of the photographic base paper optionally a back-print, the relative down web-indicia and a PE-back-coating and at the top side: a PE-top-coating and photographic, light-sensitive, silver halide layers.

The mark can be visible, or invisible for the human eye. The mark is directly applied at the web before, or after applying the back print. The mark is preferably applied at the back of the web however, it can also be applied at the top of the web. The method of providing a mark at the web may be laser engraving, ink jet printing, pinstamp techniques, moulding. The readability of the mark is not influenced by the accidental transcription of the back-print.

While the invention has been described in relation to a preferred embodiment, it is not intended to limit the scope of the invention to the particular form set forth, but on the contrary, it is intended to cover such alternatives, modifications, and equivalents as may be included within the spirit and scope of the invention as defined by the appended claims. While in the preceding a preferred embodiment has been elucidated wherein the down-web coordinate on photographic paper was measured, the method is also applicable with other materials like paper, photographic film base, metal sheet, polymer sheet or aluminium sheet material.

What is claimed is:

1. A method of identifying the location of a down-web quality problem on a web comprising:

applying to a web a position-indicating mark having an indicated down-web coordinate;

detecting a quality problem;

determining a measured down-web coordinate of said quality problem by relating a time-interval elapsed since the detection of the position-indicating mark and a measured velocity of the web; and synchronizing the measured down-web coordinate of said quality problem with the indicated down-web coordinate of the position-indicating mark.

2. Method according to claim 1, wherein, the down-web coordinate is measured in an ascending or a descending mode, depending on a detected roll-orientation information originated from said mark on said web.

3. Method according to claim 2, wherein a selected lane pattern used for registration of the cross web position is reversed automatically, depending on said roll-orientation information, originated from said mark on said web.

4. Method according to claim 1, wherein a measured down-web starting position of a quality problem area is marked on the web by an ISO-hole.

5. Method for indicating a quality problem area on a web, characterized in that a down-web starting position of the quality problem area is marked on the web by an ISO-hole.

6. System for tracking quality problem areas at continuous-web products, comprising:

one or more detection systems for detecting down-web coordinates on a web from a plurality of position-indicating marks applied on said web;

one or more product-inspection-systems provided with length-measuring circuitry synchronised with said detected down-web coordinates;

a system for data-processing of quality problem areas at least storing the measured down-web coordinates of the respective quality problem areas;

a punch control system for ISO-hole punching provided with length-measuring circuitry synchronised with said detected down-web coordinates.

7. System according to claim 6, wherein the detection systems are suited for detecting a position-indication provided by digitised information contained in said mark.

8. System according to claim 7, wherein the detection systems are suited for detecting information about the roll-orientation provided by digitized information contained in said mark.

9. System for tracking the position of quality problem areas according to claim 6, wherein said inspection-system makes use of a web length-counter that is synchronized by loading the web length-counter with the relative down web coordinate information, originated from said mark on said web.

10. System according to claim 9, wherein said inspection-system's web length-counter is automatically set into an ascending or descending counting mode, depending on said roll-orientation information, originated from said mark on said web.

11. System according to claim 9, wherein said inspection-system's web length counter switches automatically from individual counting-mode into synchronized counting-mode after being triggered via acknowledgement of said mark on said web.

12. System for tracking the position of quality problem areas according to claim 6, wherein said punch control system for ISO-hole punching makes use of a web-length counter that is synchronized by loading the web length-counter with the relative down web position information, originated from said mark on said web.

13. System according to claim 12, wherein said punch control system's web length-counter is automatically set into an ascending or descending counting mode, depending on said roll-orientation information, originated from said mark on said web.

14. System according to claim 12, wherein said punch control system's web length-counter switches automatically from individual counting-mode into synchronized counting-mode after being triggered via acknowledgement of said mark on said web.

15. Photographic paper for application in a system according to claim 6, comprising a photographic base, enclosed by a water repellent coating, on the front side of which base a photosensitive material is applied, and further comprising a plurality of position-indicating marks, characterized in that the plurality of position-indicating marks is applied directly on the photographic base.

16. Photographic paper according to claim 15, wherein the position-indication of a mark is provided by digitized information contained in said mark.

17. Photographic paper according to claim 15, wherein the roll-orientation of a mark is provided by digitized information contained in said mark.

18. Photographic paper according to claim 15, wherein said marks are not visible for the human eye.

19. Photographic paper according to claim 15, wherein said marks are applied to the back of the photographic base.

20. Photographic paper according to claim 15, wherein said marks are applied at regular intervals.

21. Photographic paper according to claim 15, wherein said marks are spaced at a distance ranging from 10 cm to 20 m.

22. Photographic paper according to claim 15, wherein said marks are applied by pinstamp techniques, moulding.

23. Photographic paper according to claim 15, wherein said marks are applied by laser engraving.

24. Photographic paper according to claim 23, wherein said mark is applied by ink jet printing.

25. The method of claim 1, wherein a production inspection system is used to detect the quality problem.

26. The method of claim 1, wherein a series of position-indicating marks are applied to the web.

27. The method of claim 26, wherein the position-indicating marks are applied at regular intervals.

28. The method of claim 27, wherein the position-indicating marks are applied at intervals of between 10 cm and 20 cm.

29. The method of claim 1, wherein the measured down-web coordinate of said quality problem is synchronized with the indicated down-web coordinate by substituting the indicated down-web coordinate for the measured down-web coordinate.

30. The method of claim 1, wherein the measured down-web coordinate is synchronized with the indicated down-web coordinate by correcting the measured down-web coordinate with an offset value.

31. The method of claim 1, further comprising determining the down-web coordinate of the position-indicating mark by reading down-web coordinate information contained in the position-indicating mark.

32. The method of claim 1, further comprising determining the down-web coordinate of the position-indicating mark by counting a total of detected position-indicating marks and multiplying by a known interval between position-indicating marks.

* * * * *